US011559154B2

(12) United States Patent
Hendrik Van Ee

(10) Patent No.: US 11,559,154 B2
(45) Date of Patent: Jan. 24, 2023

(54) HAND HEART HOLDER

(71) Applicant: Jonathan Hendrik Van Ee, Dublin, CA (US)

(72) Inventor: Jonathan Hendrik Van Ee, Dublin, CA (US)

( * ) Notice: Subject to any disclaimer, the term of this patent is extended or adjusted under 35 U.S.C. 154(b) by 0 days.

(21) Appl. No.: 17/305,445

(22) Filed: Jul. 7, 2021

(65) Prior Publication Data

US 2022/0039572 A1 Feb. 10, 2022

Related U.S. Application Data

(60) Provisional application No. 62/706,232, filed on Aug. 6, 2020.

(51) Int. Cl.

| | |
|---|---|
| ***A47G 19/02*** | (2006.01) |
| ***B65D 21/02*** | (2006.01) |
| ***B65D 81/36*** | (2006.01) |

(52) U.S. Cl.

CPC ..... *A47G 19/025* (2013.01); *B65D 21/0209* (2013.01); *B65D 81/365* (2013.01)

(58) Field of Classification Search

CPC .. A47G 19/03; A47G 19/025; B65D 21/0233; B65D 21/0234; B65D 85/36

See application file for complete search history.

(56) References Cited

U.S. PATENT DOCUMENTS

| | | | | |
|---|---|---|---|---|
| 2,627,991 A * | 2/1953 | Maersch | B65D 21/0234 206/508 |
| 2009/0065514 A1* | 3/2009 | Vovan | B65D 21/0234 220/635 |
| 2017/0057697 A1* | 3/2017 | Fee | B65D 25/2897 |
| 2017/0202379 A1* | 7/2017 | Vucicevic | A61B 5/053 |

* cited by examiner

*Primary Examiner* — Andrew T Kirsch

(57) ABSTRACT

The Invention is a standard set of round, cylindrical and spherical pieces that form objects to hold other objects and food, to transport things and to build modular elegant and beautiful constructions. For example, the Invention's pieces can be used as spherical flowerpots that are arranged along a walkway with flowers, and those same flowerpots can be stacked to support a flowerpot a few feet off the ground. Furthermore, the flowerpots can be stacked to form columns that vines grow on. Pieces can be made exponentially larger and smaller, and features on pieces can also be made exponentially larger and smaller, while maintaining compatibility within the system of Invention pieces. For example, the stacked boxes that are FIG. 33 can be elongated to stack in a manner that forms the pattern of a standard brick wall's interlocking pieces.

3 Claims, 23 Drawing Sheets

HAND HEART HOLDER

BACKGROUND OF THE INVENTION

Field of the Invention

With circular and spherical pieces, the Hand Heart Holder (the "Invention") series of pieces build bowls, trays, necklaces, and spheres that hold objects (including food), stack to form structures, and form stackable hands that snap together when holding an object in the form of a heart.

Description of Related Art

Round and spherical bowls hold food.

There are necklaces that have hands as ornaments.

BRIEF SUMMARY OF THE INVENTION

The Invention uses simple standard measurements and design specifications to create circles and spheres that can be assembled by stacking together in a series of different and reversible ways.

The Invention's pieces use undulating surfaces to fit into themselves on top of one another, as lids to themselves, and as enclosed spaces that can be stacked (i.e., as lids of themselves in pieces that are also securely stacked on top of each other).

The Invention's spherical objects can transport smaller parts of the Invention inside the spheres so the Invention provides not just stackable objects and enclosed spaces and containers, it also forms its own transportation mechanism in the form of spheres carrying Invention objects and other objects through an area or through a construction. In this manner the Invention can build itself. When rounded surfaces of the Invention's objects are magnetized so that they can fit together magnetically or so that they can be propelled through constructions made of the Invention's objects, the Invention can self-assemble constructions.

The Invention's pieces are useful stable building blocks that also are aesthetically appealing in that they communicate a message of love and care and in that they embody useful design that is also beautiful.

The Invention can be made with a wide range of materials including ceramic, metal, glass, plastic materials and combinations of these materials and other recycled or natural materials.

BRIEF DESCRIPTION OF THE SEVERAL VIEWS OF THE DRAWINGS

FIG. 1I A is a half sphere with undulating sides that fit into themselves in a manner similar to FIG. 9A except FIG. 11A has more undulations.

FIG. 12 through 17A are examples of how the different pieces fit into themselves into one stable stacked column despite the differences in undulation steepness and despite the differences in undulating patterns that certain of the pieces have.

FIG. 14 is an example of how FIG. 2A fits into FIG. 1A.

FIG. 15 is an example of how FIG. 3B fits into FIG. 14.

FIG. 16 is an example of how FIG. 3B fits into FIG. 15.

FIG. 17A is an example of how FIG. 13 fits into FIG. 16.

FIG. 26 at element 1 is an up-close view of the "s" snap on the ring finger.

FIG. 27A is also different from FIG. 25A in that FIG. 27A has ridges on its inside in the manner shown at FIGS. 27E, elements 3 and 4.

DETAILED DESCRIPTION OF THE INVENTION

Figure 1A:
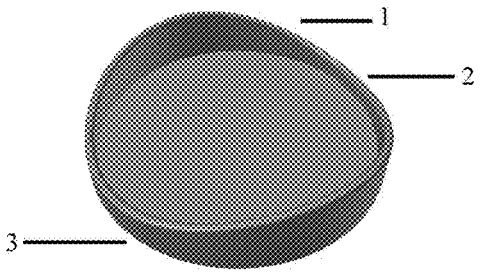
FIG. 1A is an undulating (1, 2) tray with a smooth bottom (3) whose top (1) fits into itself (2) to form an enclosed disc in a manner similar to that shown in FIG. 14 (the assembled piece's lips (41, 42) in FIG. 14 have the same undulating design as FIG. 1A but the wavy bottom that appears in FIG. 14 is different from the flat bottom (3) of FIG. 1A).
Figure 14:
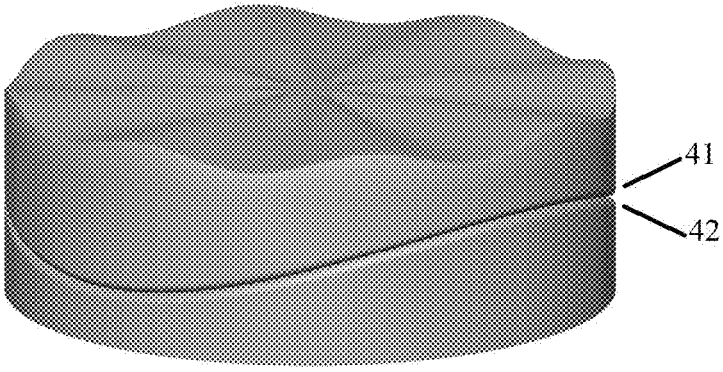

FIG. 1A is an undulating tray (1, 2) with a smooth bottom (3) whose top fits into itself to form an enclosed disc in a manner similar to that shown in FIG. 14 (the assembled piece's lips (41, 42) in FIG. 14 have the same undulating design as FIG. 1A but the wavy bottom that appears in FIG. 14 (41, 42) is different from the flat bottom (3) of FIG. 1A).

Figure 1B:
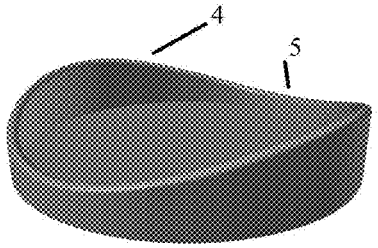
FIG. 1B is the undulating tray (4, 5) shown in FIG. 1A except the drawing in FIG. 1B shows the tray from more of a side angle.

FIG. 1B is the undulating tray (4, 5) shown in FIG. 1A except the drawing in FIG. 1B shows the tray from more of a side angle. The low points of the edges (for example, the low point at element 5) are negatively charged magnetically and the high points (for example, at element 4) are positively charged so that the pieces not only fit into each other because of their shape but they also affix themselves to each other because of their magnetic charge.

Figure 2A:
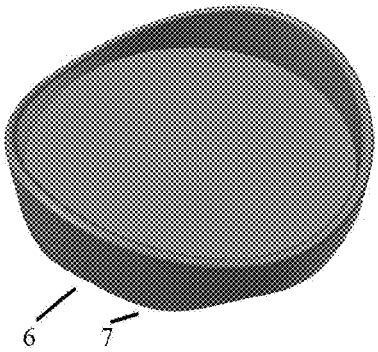
FIG. 2A is similar to FIG. 1A except it has a wavy bottom (6, 7). It fits into itself in the manner shown in FIG. 14.

FIG. 2A is similar to FIG. 1A except it has a wavy bottom (6, 7). It fits into itself in the manner shown in FIG. 14.

Figure 2B:
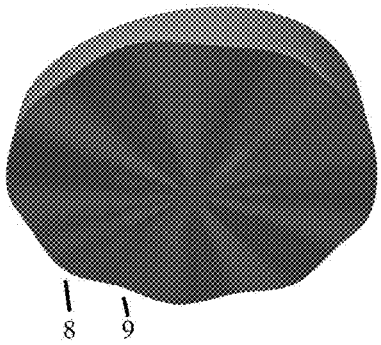
FIG. 2B is a view from the bottom of the undulating bottom (8, 9) of the tray shown in FIG. 2A.

FIG. 2B is a view from the bottom of the undulating bottom (8, 9) of the tray shown in FIG. 2A. As with the edges of the tray at FIG. 1B, elements 4 and 5, the undulating bottom at FIG. 2B is also magnetized so that the object affixes itself to other objects just like itself and to other undulating surface objects that are part of the invention. As with the charges of protruding and receding edges at elements 4 and 5, the protruding undulation at element 8 is positively charged and the receding undulation at element 9 is negatively charged so they can fit into each other and into other undulating pieces in the invention and also be affixed to each other magnetically with pieces that have opposite magnetic charges attracting each other.

Figure 2C:
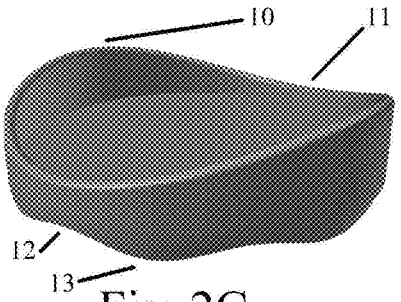

FIG. 2C is a side view of the undulating tray (10, 11) with a wavy bottom (12, 13) that is shown in FIG. 2A and FIG. 2B.

Figure 3A:
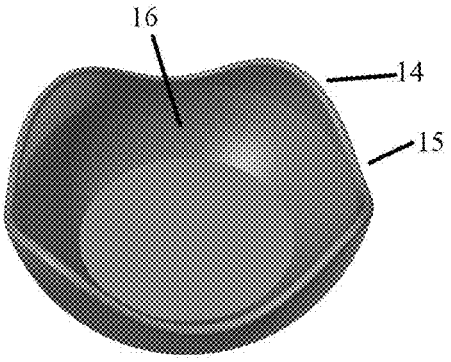
FIG. 3A is similar to the prior pieces except its undulating sides are on a sphere and not a cylindrical shape like the prior shapes.

FIG. 3A is similar to the prior pieces except its undulating sides (14, 15) are on a sphere (16) and not a cylindrical shape like the prior shapes. It fits into itself and into other pieces in the manner generally shown in FIGS. 15 and 16.

Figure 3B:
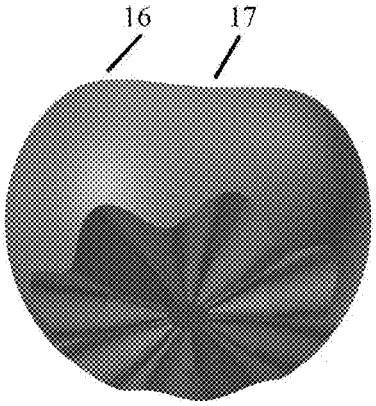
FIG. 3B is a view from the bottom of the spherical undulating tray shown in FIG. 3A.

FIG. 3B is a view from the bottom of the spherical undulating tray (16, 17) shown in FIG. 3A.

Figure 3C:
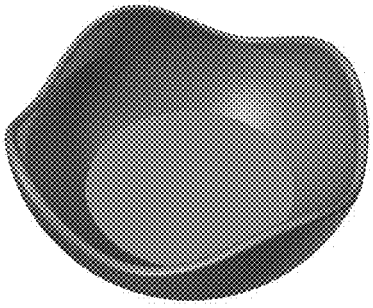
FIG. 3C is similar to the view of the tray shown in FIG. 3A except the view in FIG. 3C is more from the side.

FIG. 3C is similar to the view of the tray shown in FIG. 3A except the view in FIG. 3C is more from the side.

Figure 4A:
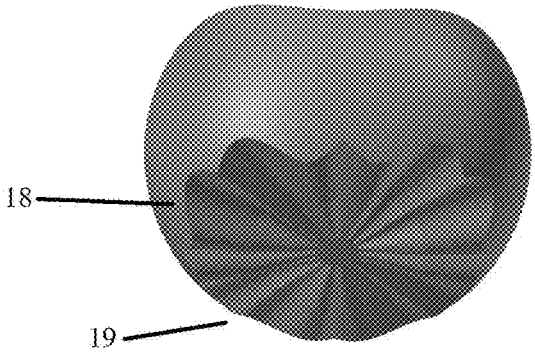
FIG. 4A is similar to FIG. 3B except its undulations follow a different pattern to take on a different artistic shape.

FIG. 4A is similar to FIG. 3B except its undulations (18, 19) follow a different pattern to take on a different artistic shape.

Figure 4B:
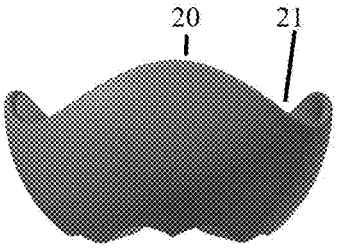
FIG. 4B is a side view of the undulating tray shown in FIG. 4A.

FIG. 4B is a side view of the undulating tray (20, 21) shown in FIG. 4A.

Figure 5A:
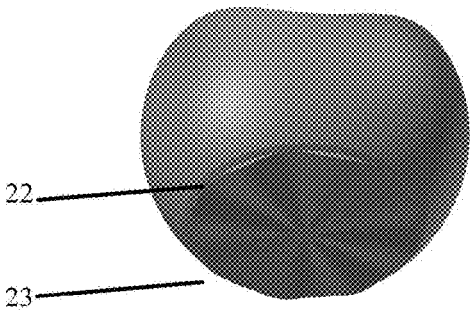
FIG. 5A is similar to FIG. 3B except its undulating bottom has undulations that are less pronounced.

FIG. 5A is similar to FIG. 3B except its undulating bottom (22, 23) has undulations that are less pronounced.

Figure 5B:
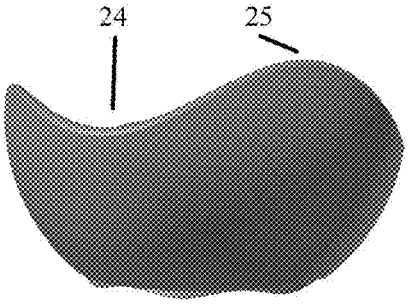
FIG. 5B is a side view of the undulating tray shown in FIG. 5A.

FIG. 5B is a side view of the undulating tray (24, 25) shown in FIG. 5A.

Figure 6A:
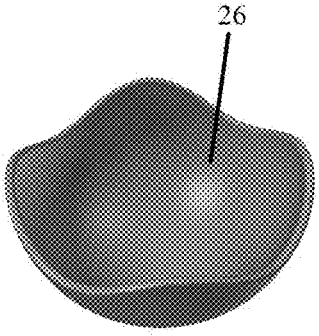
FIG. 6A is a view at an angle from the top of a half sphere that fits into itself to form a sphere. It also is a lid to certain of the prior pieces.

FIG. 6A is a view at an angle from the top of a half sphere (26) that fits into itself to form a sphere. It also is a lid to certain of the prior pieces.

Figure 6B:
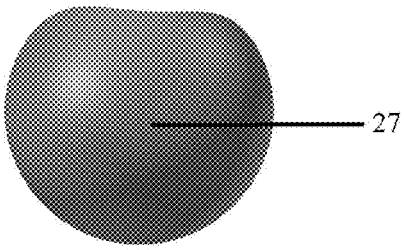
FIG. 6B is a view from the bottom of the half sphere shown in FIG. 6B.

FIG. 6B is a view from the bottom (27) of the half sphere shown in FIG. 6B.

Figure 7:
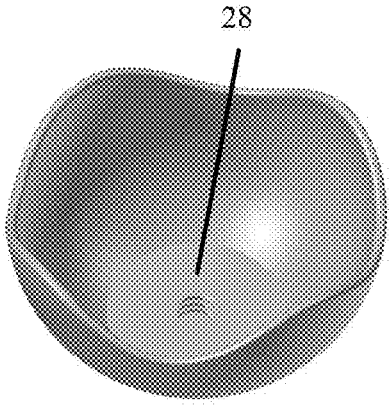
FIG. 7 is similar to FIG. 6A except it has a female screw interface in the middle center of itself into which the shaft that is FIG. 8A can be screwed as shown in in FIG. 9A.
Figure 8A:
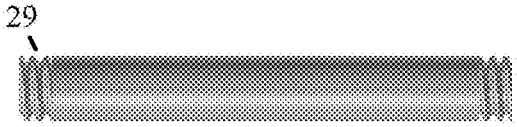
FIG. 8A is a profile view of a shaft that can be screwed into FIG. 7 in the manner shown in FIG. 9A.
Figure 9A:
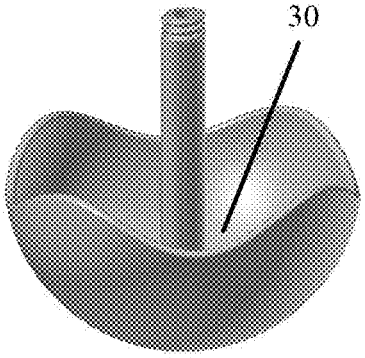
FIG. 9A is a depiction of how the shaft in FIG. 8A fits into the undulating half bowl in FIG. 7.
Figure 9B:
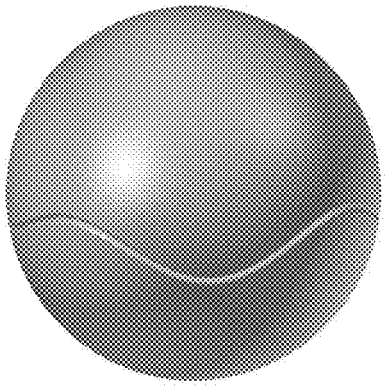
FIG. 9B is a depiction of how another undulating half bowl in the form of the bowl shown in FIG. 7 can be screwed on to the top of the pieces assembled in FIG. 9A to form a sphere.

FIG. 7 is similar to FIG. 6A except it has a female screw interface in the middle center of itself (28) into which the shaft that is FIG. 8A (at element 29) can be screwed as shown in in FIG. 9A at element 30. Another flexible shape that is FIG. 7 can then be screwed onto the top of FIG. 9A to form a sphere as is shown in FIG. 9B.

FIG. 8A is a profile view of a shaft that can be screwed into FIG. 7 in the manner shown in FIG. 9A at element 30.

Figure 8B:
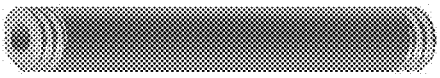
FIG. 8B is a view from the side of the shaft shown in FIG. 8A.

FIG. 8B is a view from the side of the shaft shown in FIG. 8A.

FIG. 9A is a depiction of how the shaft in FIG. 8A fits into the undulating half bowl in FIG. 7 at element 30.

FIG. 9B is a depiction of how another undulating half bowl in the form of the bowl shown in FIG. 7 can be screwed on to the top of the pieces assembled in FIG. 9A to form a sphere.

Figure 10A:
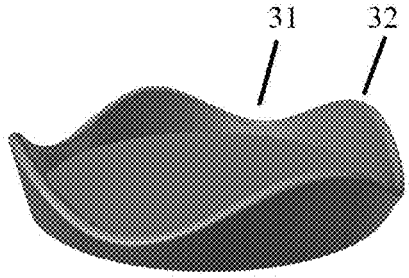
FIG. 10A is a platter with undulating sides that fit into themselves in the manner shown in FIG. 12.
Figure 12:
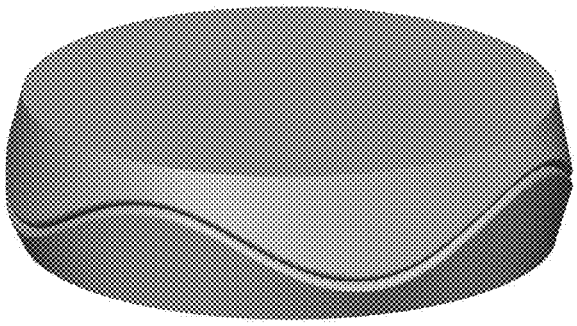
FIG. 12 is an example of how the different pieces fit into themselves into one stable stacked column despite the differences in undulation steepness and despite the differences in undulating patterns that certain of the pieces have.

FIG. 10A is a platter with undulating sides (31, 32) that fit into themselves in the manner shown in FIG. 12.

Figure 10B:
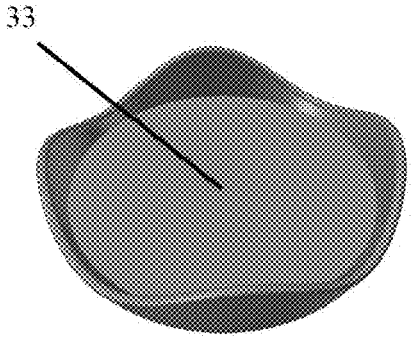
FIG. 10B is a view more from the top of the platter shown in FIG. 10A.

FIG. 10B is a view more from the top of the platter (33) shown in FIG. 10A.

Figure 11A:
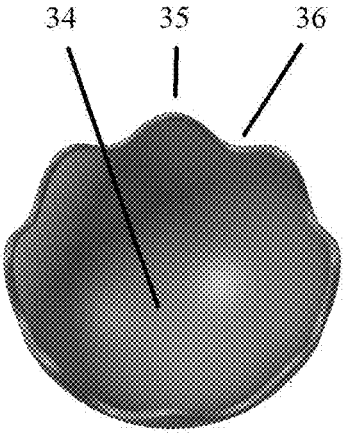
FIG. 11B is a view more from the side of the half sphere shown in FIG. 11A.
FIG. 11C is a profile view of the half sphere with undulating sides shown in FIG. 11A.

FIG. 1I A is a half sphere (34) with undulating sides (35, 36) that fit into themselves in a manner similar to FIG. 9 except FIG. 11A has more undulations (35, 36).

Figure 11B:
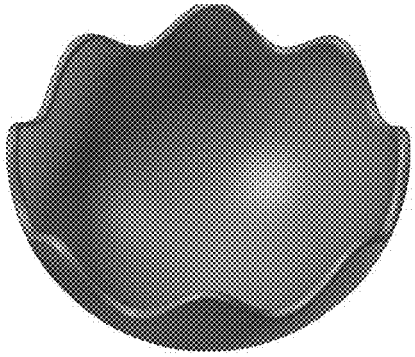

FIG. 11B is a view more from the side of the half sphere shown in FIG. 11A.

Figure 11C:
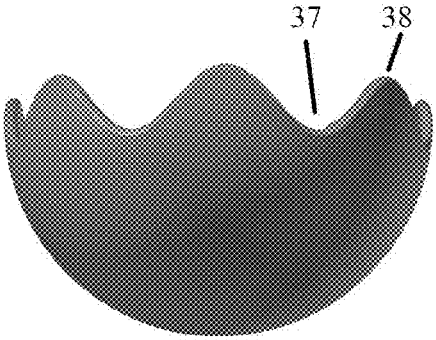

FIG. 11C is a profile view of the half sphere with undulating sides (37, 38) shown in FIG. 11A.

Figure 13:
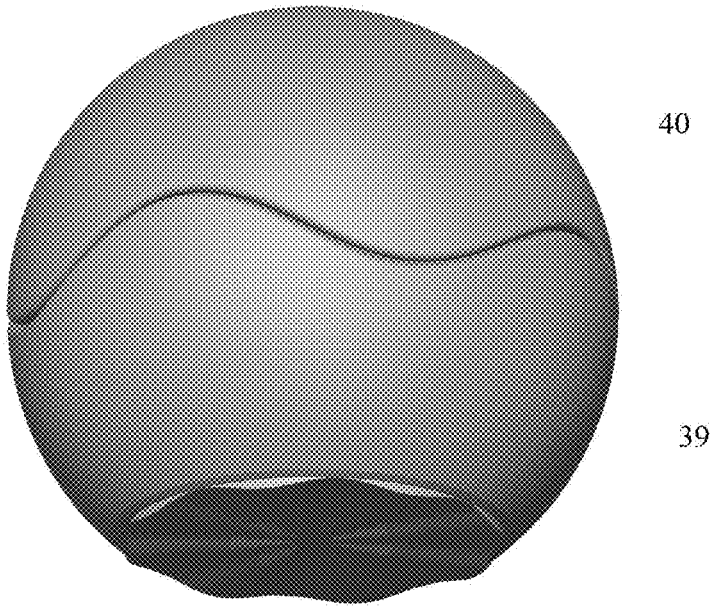
FIG. 13 is an example of how FIGS. 5A holds FIG. 6A as a lid.

FIG. 13 is an example of how FIG. 5A (at element 39) holds FIG. 6A (40) as a lid.

FIG. 12 through 17 are examples of how the different pieces fit into themselves into one stable stacked column despite the differences in undulation steepness and despite the differences in undulating patterns that certain of the pieces have.

FIG. 14 is an example of how FIG. 2A fits into FIG. 1A.

Figure 15:
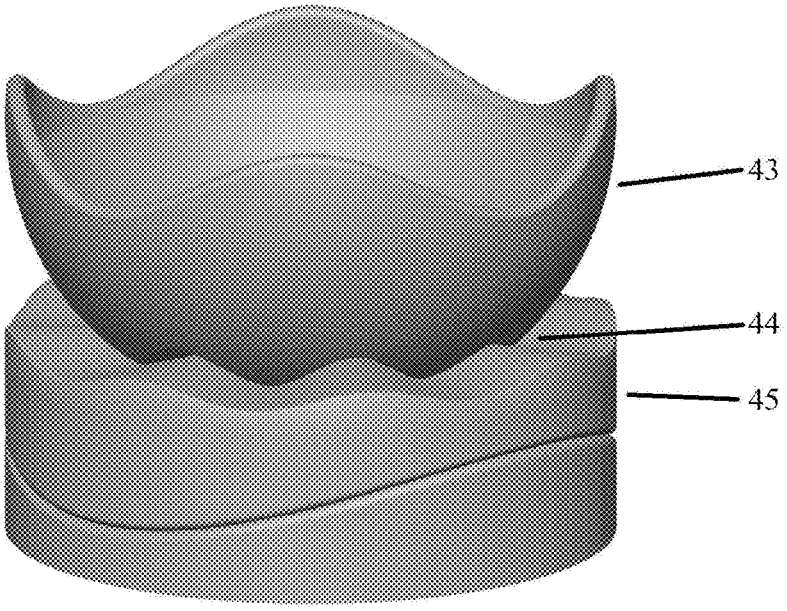

FIG. 15 is an example of how FIG. 3B (43) fits into (44) FIG. 14 (45).

Figure 16:
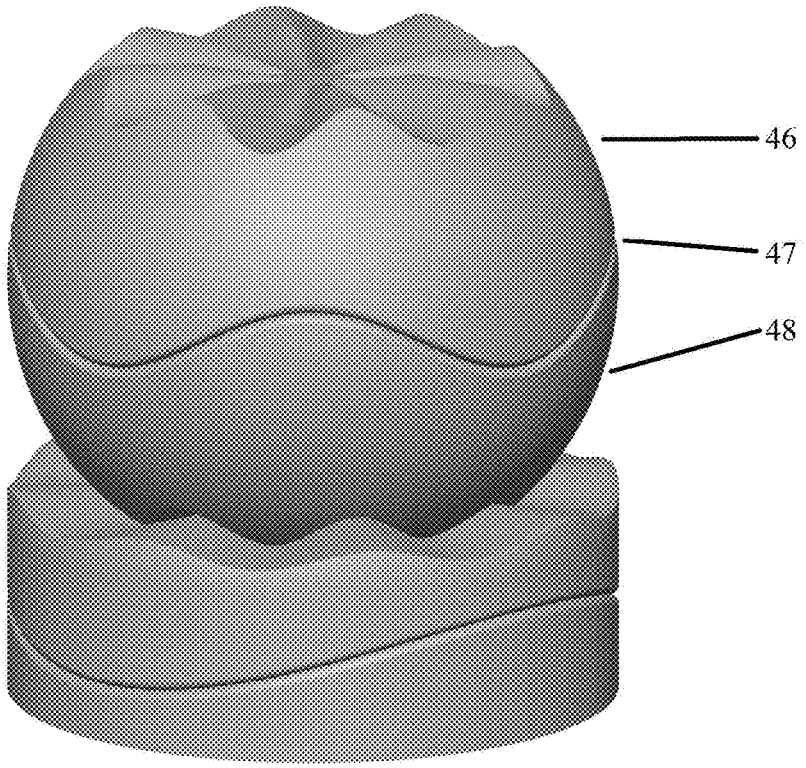

FIG. 16 is an example of how FIG. 3B (46) fits into (47) FIG. 15 (48).

Figure 17A:
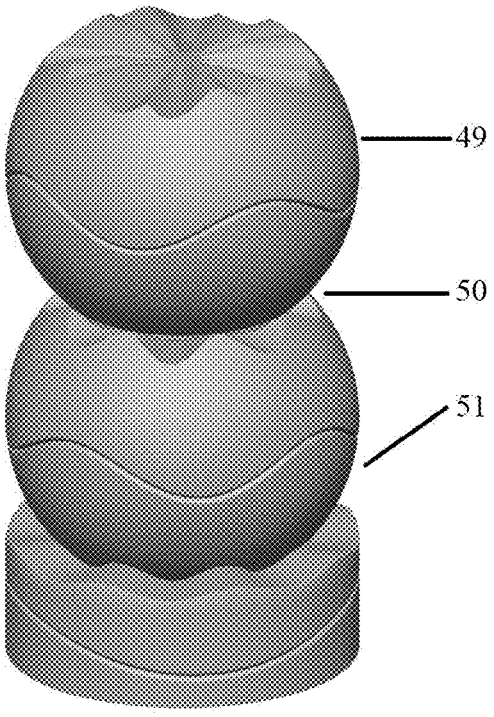

FIG. 17A is an example of how FIG. 13 (49) fits into (50) FIG. 16 (51).

Figure 17B:
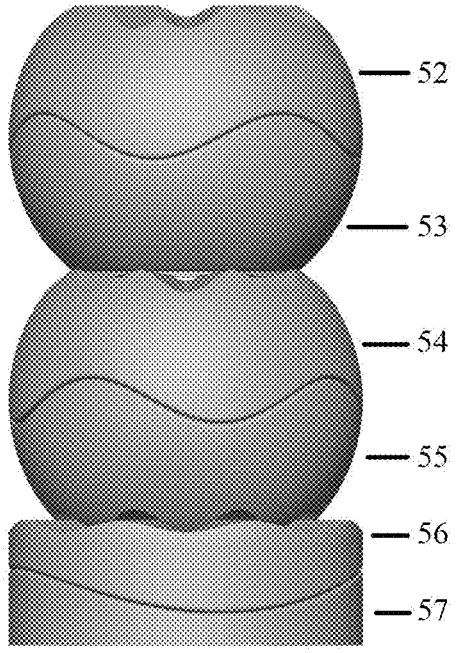
FIG. 17B is a profile view of the stacked pieces in FIG. 17A.

FIG. 17B is a profile view of the stacked pieces (52, 53, 54, 55, 56, 57) in FIG. 17A.

Figure 17C:
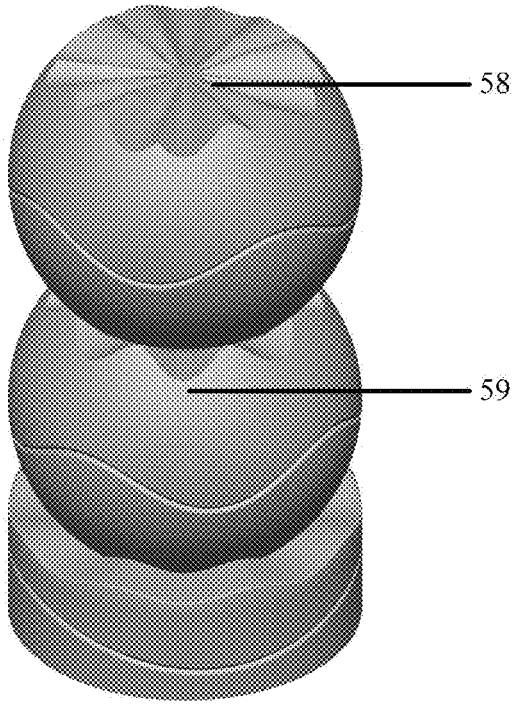
FIG. 17C is a view from the top and to one side of the stacked pieces in FIG. 17A.

FIG. 17C is a view from the top (58) and to one side (59) of the stacked pieces in FIG. 17A.

Figure 18A:
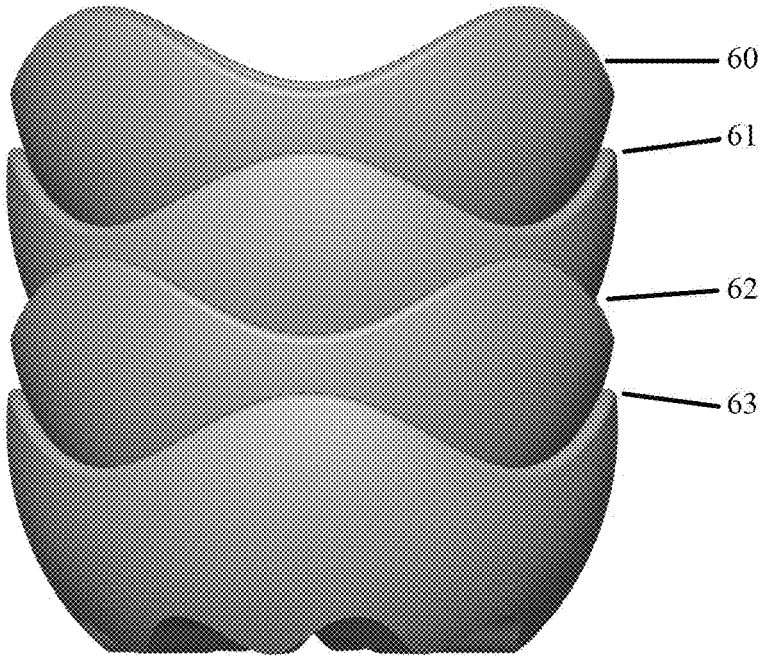
FIG. 18A is an example of how FIG. 3A stacks in a fitted manner to save space.

FIG. 18A is a profile view of an example of how FIG. 3A (60) stacks in a fitted manner (61) to save space (i.e., one piece fits into another piece (61), which in turn fits into another piece (62, 63) like stacked paper cups).

Figure 18B:
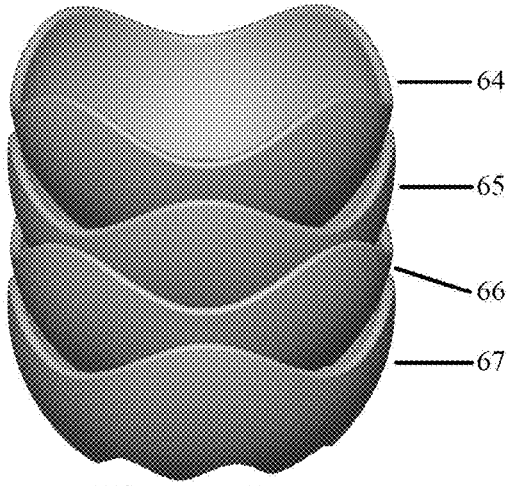
FIG. 18B is a view from the side of the pieces stacked in the manner shown in FIG. 18A.

FIG. 18B is a view from the side of the pieces (64, 65, 66, 67) stacked in the manner shown in FIG. 18A.

Figure 18C:
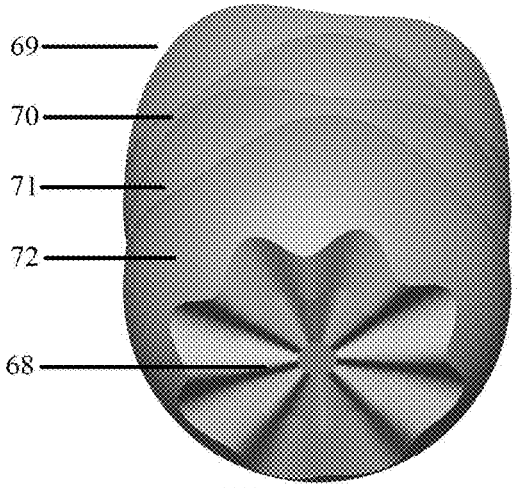
FIG. 18C is a view from the bottom of the pieces stacked in the manner shown in FIG. 18A.

FIG. 18C is a view from the bottom (68) of the pieces (69, 70, 71, 72) stacked in the manner shown in FIG. 18A.

Figure 19:
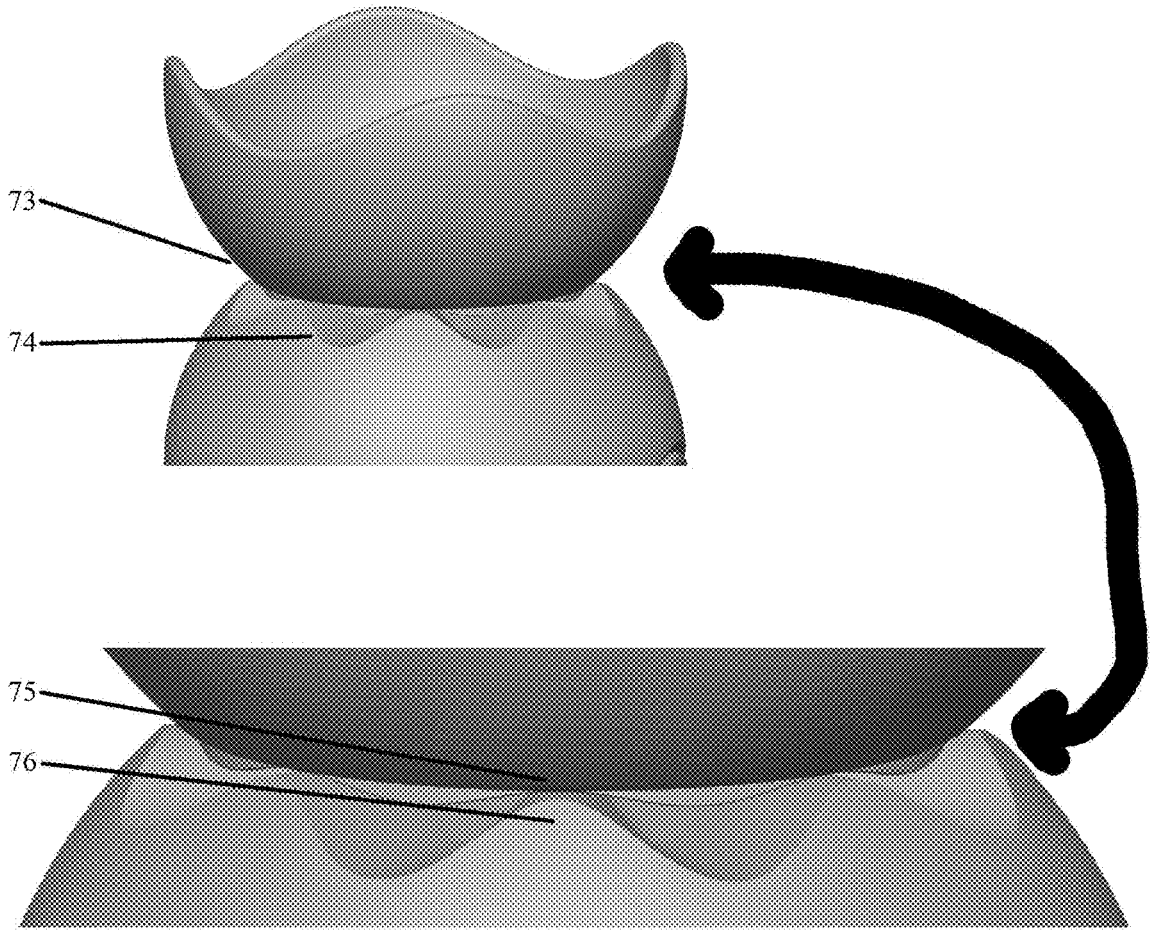
FIG. 19 is a demonstration of how pieces with different steepness in their undulations fit together in a stable manner.

FIG. 19 is a demonstration of how pieces with different steepness in their undulations (73, 74) fit together in a stable manner (75, 76).

Figure 20A:
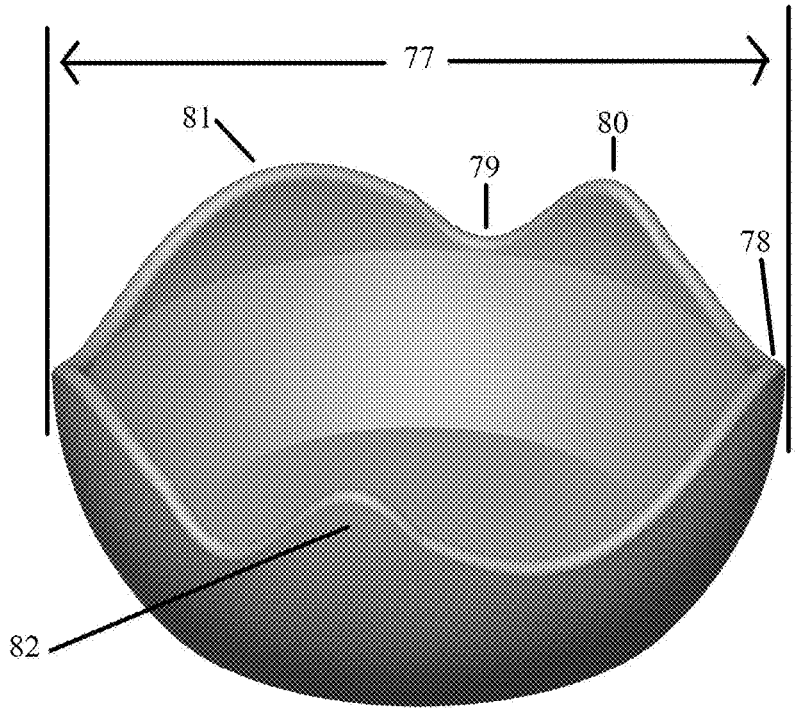
FIG. 20A is an example of how the Invention's features have dimensions whose ratio to the rest of the Invention object creates sizes that are always divisible by two for ease of design.

FIG. 20A is an example of how the Invention's features have dimensions whose ratio to the rest of the Invention object creates sizes that are always divisible by two for ease of design. For example, if the diameter of a bowl is 128 millimeters (77), then the lips (78) will be 4 millimeters. If FIG. 1A has a diameter of 128 millimeters (77) then the full distance covered by the undulating sides (from the lowest point of undulation at element 79 to the highest point at element 80) will cover 16 millimeters. To fit into themselves, the undulations always must be of an even number (i.e. two protruding undulations in FIG. 1A, four undulations in FIG. 3A and so on). The standard and even nature of these numbers allows them to be easily understood so that they can be adapted to be used by others, so that the objects can be manufactured with more ease by following standard conventions, and so that they can be combined together more easily. For example, FIG. 20A combines two kinds of undulating edges (81, 82): the undulating sides of FIG. 3A (four protruding bumps, one of which is at element 81) are combined with the undulating sides of FIG. 11A (with eight protruding bumps, one of which is at element 82).

Figure 20B:
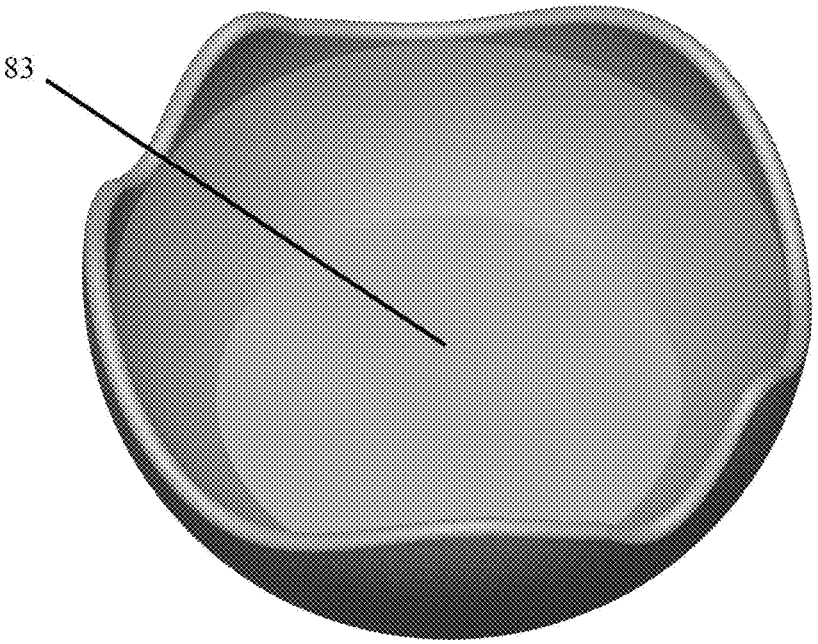
FIG. 20B is a view more from the top of the undulating platter shown in FIG. 20A.

FIG. 20B is a view more from the top of the undulating platter (83) shown in FIG. 20A.

Figure 21A:
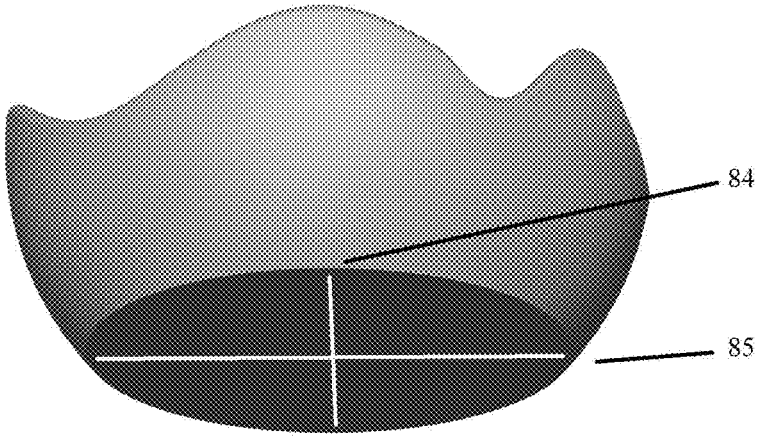
FIG. 21A is FIG. 20A except that the dimensions on one of its horizontal axis is one-fourth less than the dimensions of the other horizontal axis.

FIG. 21A is FIG. 20A except that the dimensions on one of its horizontal axes (84) is one-fourth less than the dimensions of the other horizontal axis (85). This gives it an oval shape.

Figure 21B:
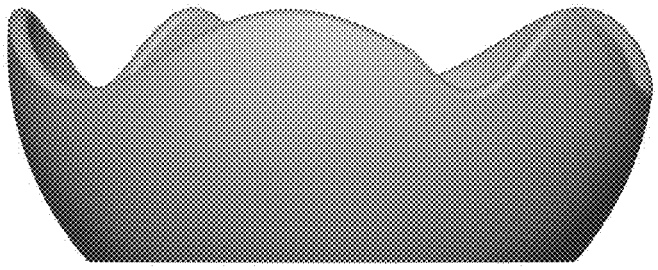
FIG. 21B is a profile view of the object shown in FIG. 21A.

FIG. 21B is a profile view of the object shown in FIG. 21A.

Figure 21C:
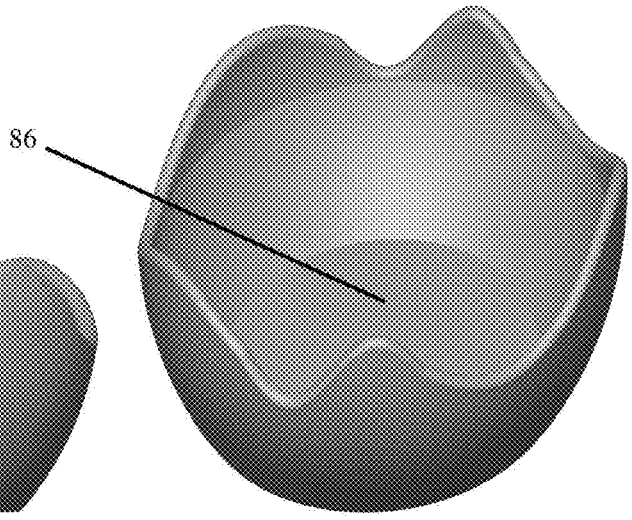
FIG. 21C is a view from the top and to one side of the object shown in FIG. 21A.

FIG. 21C is a view from the top (86) and to one side of the object shown in FIG. 21A.

Figure 21D:
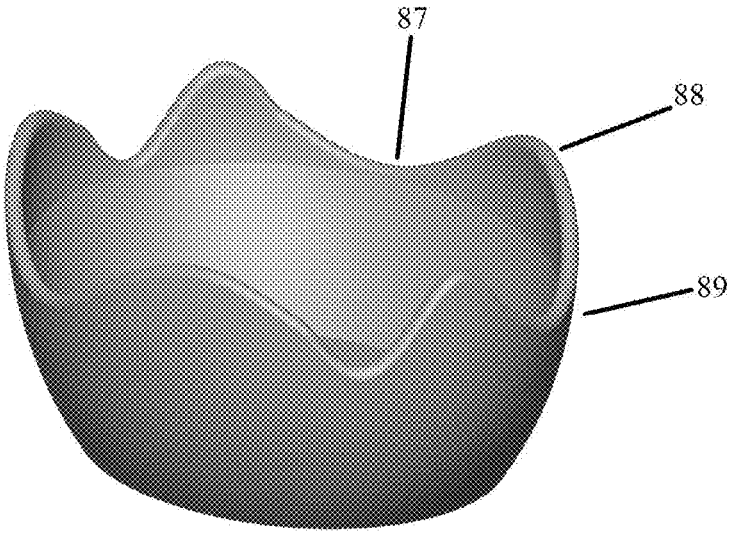
FIG. 21D is a view of the object shown in FIG. 21A from a different side angle to show the different view of the undulations.

FIG. 21D is a view of the object shown in FIG. 21A from a different side angle to show the different view of the undulations (87, 88, 89).

Figure 21E:
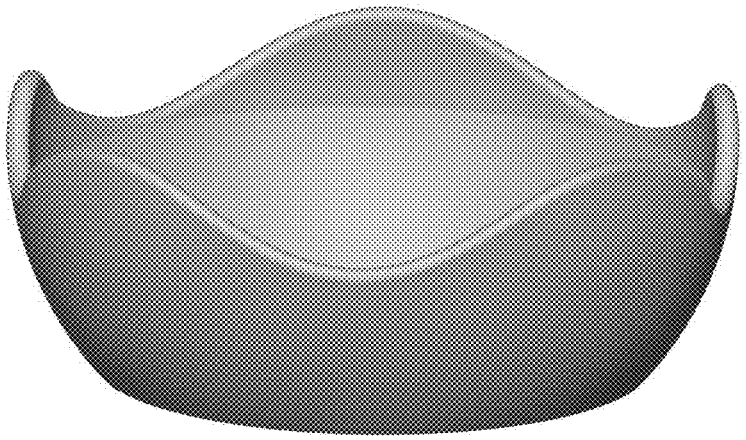
FIG. 21E is a side view showing the full length of the oval shape shown in FIG. 21A.

FIG. 21E is a side view showing the full length of the oval shape shown in FIG. 21A.

Figure 21F:
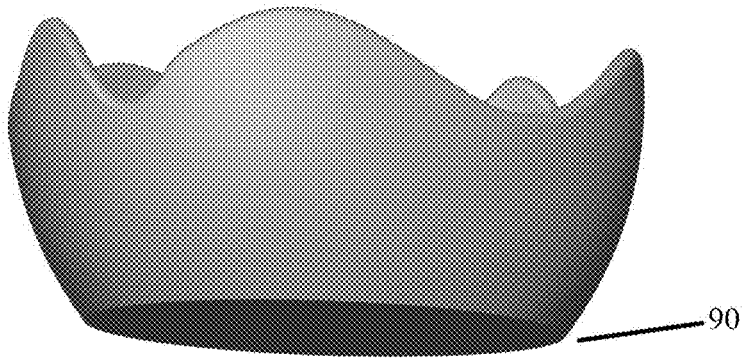
FIG. 21F is a view of the bottom of the object shown in FIG. 21A.

FIG. 21F is a view of the bottom (90) of the object shown in FIG. 21A.

Figure 22A:
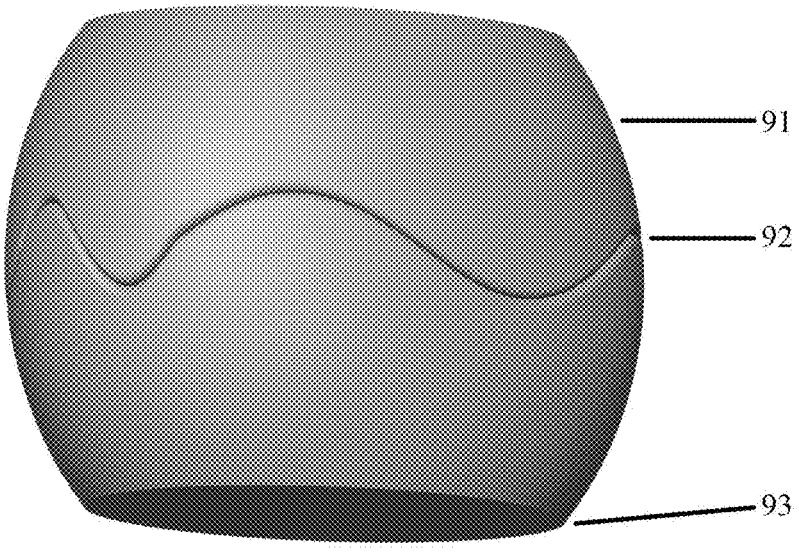
FIG. 22A is a demonstration of how FIG. 21A fits into itself to form an enclosed space that can also be stacked on top of itself and on top of other pieces with flat surfaces that were previously discussed.

FIG. 22A is a demonstration of how FIG. 21A (91) fits into itself (92) to form an enclosed space that can also be stacked on top of itself and on top of other pieces with flat surfaces (93) that were previously discussed.

Figure 22B:
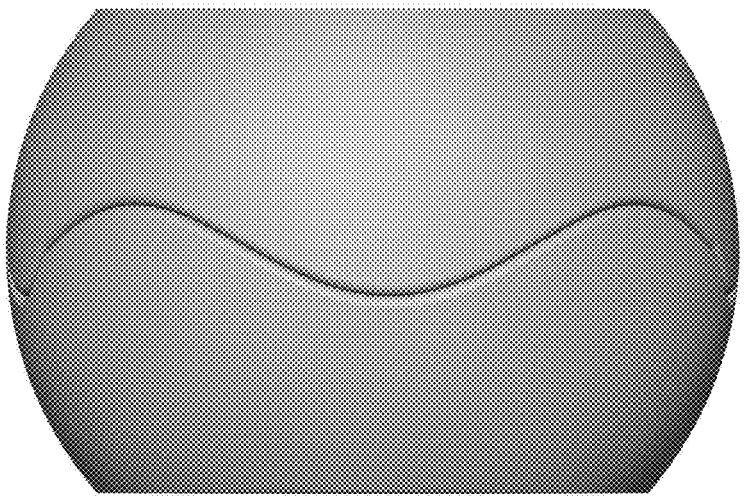
FIG. 22B is a profile view of the full length of the assembled objects shown in FIG. 22A.

FIG. 22B is a profile view of the full length of the assembled objects shown in FIG. 22A.

Figure 22C:
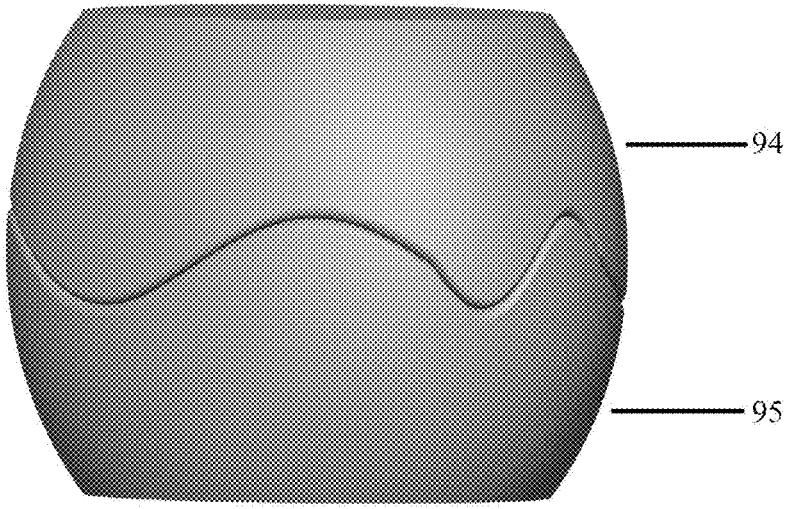
FIG. 22C is a profile view at an angle of the assembled objects shown in FIG. 22A.

FIG. 22C is a profile view at an angle of the assembled objects (94, 95) shown in FIG. 22A.

Figure 22D:
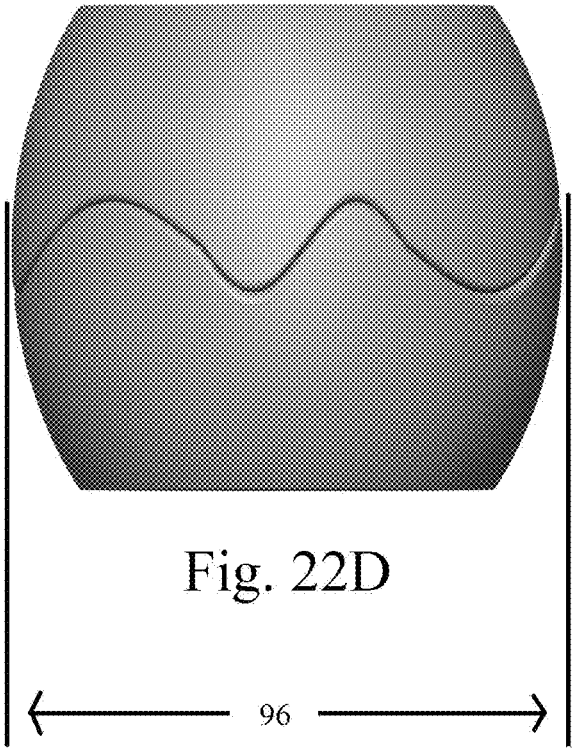
FIG. 22D is a profile view of the oval shape in FIG. 22A that shows its shortest width.

FIG. 22D is a profile view of the oval shape in FIG. 22A that shows its shortest width (96).

Figure 22E:
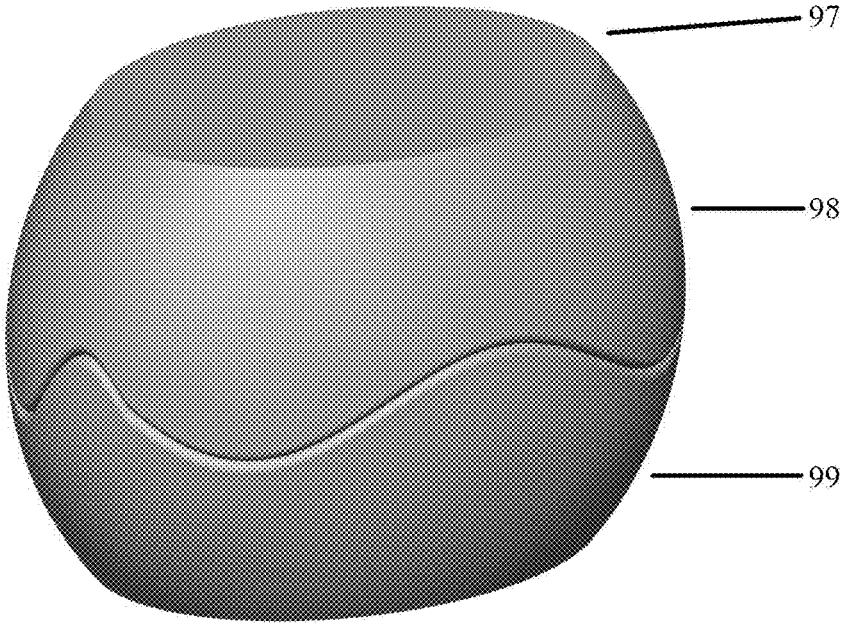
FIG. 22E is a view from the top and to one side of the assembled objects shown in FIG. 22A.

FIG. 22E is a view from the top (97) and to one side of the assembled objects (98, 99) shown in FIG. 22A.

Figure 23A:
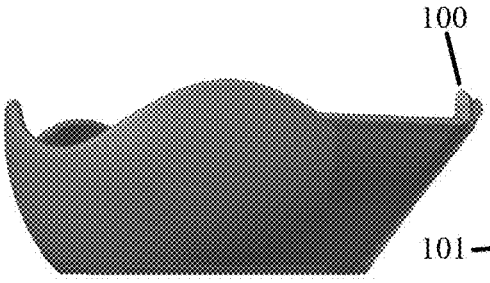
FIG. 23A is similar to FIG. 22A except that four fingers have been placed on one side of the top and the bone configuration on the back of a person's hand appears in the undulating pattern on the bottom of FIG. 23A as is shown in FIGS. 23B and 23D.
Figure 23B:
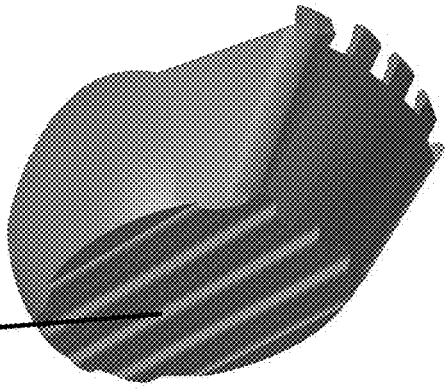
FIG. 23B is a view from the bottom and to one side of the object in FIG. 23A.

FIG. 23A is similar to FIG. 22A except that four fingers have been placed on one side of the top (100) and the bone configuration on the back of a person's hand appears in the undulating pattern on the bottom of FIG. 23A as is shown in FIGS. 23B (101) and 23D (102). These pieces fit together in a manner similar to that shown in FIGS. 32B and 32C.

FIG. 23B is a view from the bottom (101) and to one side of the object in FIG. 23A.

Figure 23C:
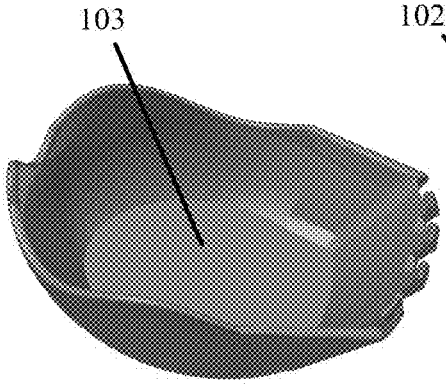
FIG. 23C is a view from the top of the object shown in FIG. 23A.

FIG. 23C is a view from the top of the object (103) shown in FIG. 23A.

Figure 23D:
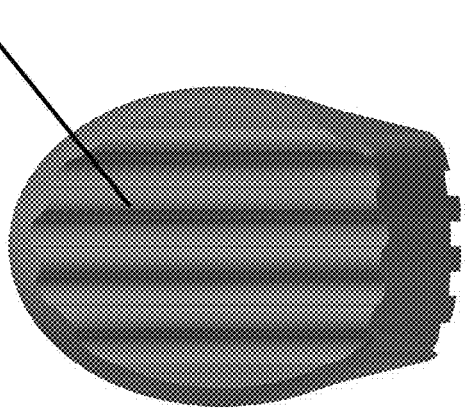
FIG. 23D is a profile view from the bottom of the object shown in FIG. 23A.

FIG. 23D is a profile view from the bottom of the object shown in FIG. 23A.

Figure 24A:
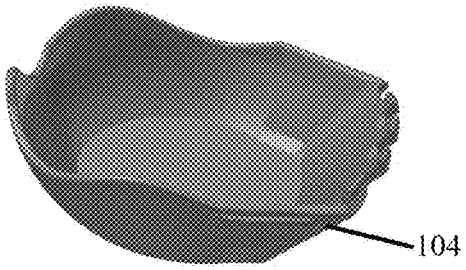
FIG. 24A is similar to FIG. 23C except it has a protruding bump towards the top of the piece that has the shape of a thumb as is evident towards the top of FIG. 24E.
Figure 24B:
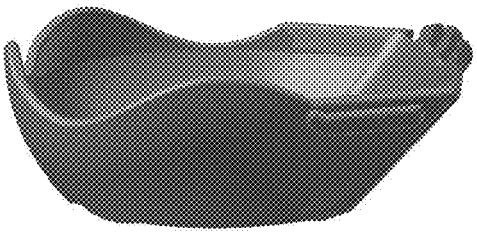
FIG. 24B is a side view of the object in FIG. 24A.
Figure 24C:
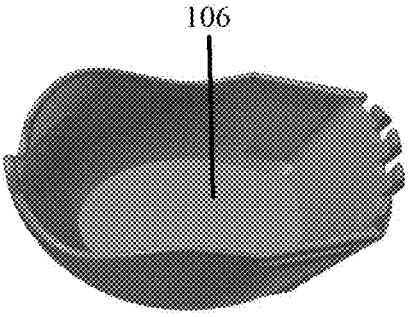
FIG. 24C is a view from the side and from above of the object in FIG. 24A.
Figure 24D:
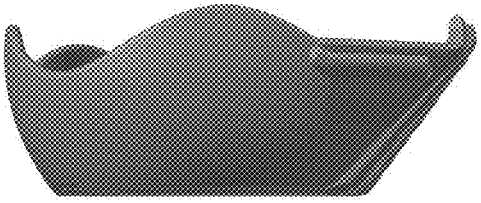
FIG. 24D is a profile view of the object in FIG. 24A.
Figure 24E:
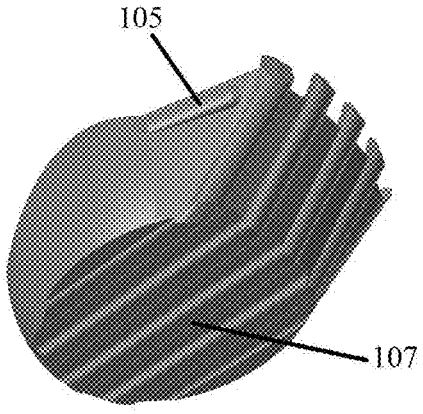
FIG. 24E is a view at an angle from the bottom of the object in FIG. 24A.

FIG. 24A is similar to FIG. 23C except it has a protruding bump towards the top of the piece (104) that has the shape of a thumb as is evident towards the top of FIG. 24E (105).

FIG. 24B is a side view of the object in FIG. 24A.

FIG. 24C is a view from the side and from above (106) of the object in FIG. 24A.

FIG. 24D is a profile view of the object in FIG. 24A.

FIG. 24E is a view at an angle from the bottom (107) of the object in FIG. 24A.

Figure 24F:
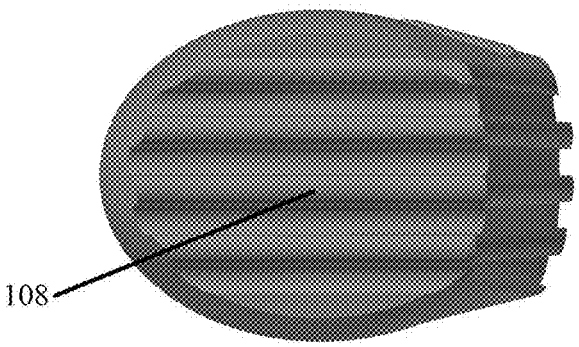
FIG. 24F is a view from the bottom of the object in in FIG. 24A.

FIG. 24F is a view from the bottom of the object (108) in FIG. 24A.

Figure 25:
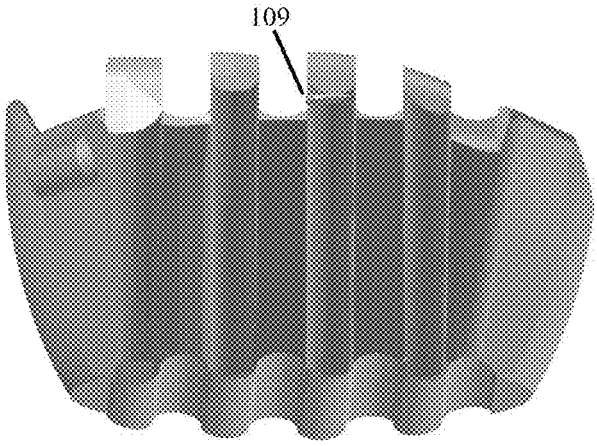
FIG. 25 is similar to FIG. 24A except it has a ring on its ring finger that operates as an "s" snap that holds the pieces together to snap them together.

FIG. 25 is similar to FIG. 24A except it has a ring on its ring finger (109) that operates as an "s" snap that holds the pieces together to snap them together.

Figure 26:
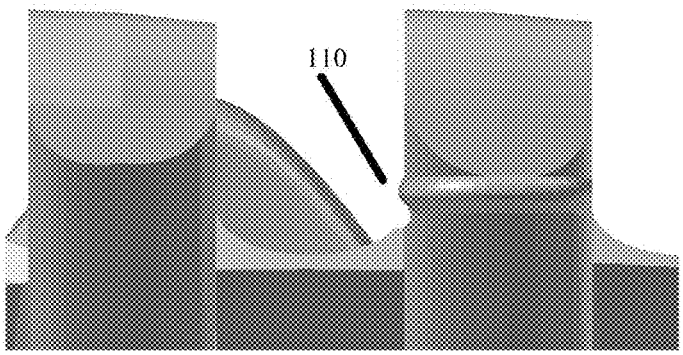
FIG. 26 is an up-close view of FIG. 25.

FIG. 26 at element 110 is an up-close view of the "s" snap on the ring finger.

Figure 27A:
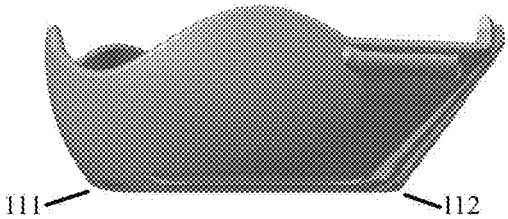
FIG. 27A is similar to FIG. 25A except that the bottom edges of the hand are rounded.

FIG. 27A is similar to FIG. 25A except that the bottom edges of the hand (111, 112) are rounded. This can be seen in the rounded bottom left part of FIG. 27A (111) and in the glistening part to the left of FIG. 27D, which shows a different view of the same object, as denoted by element 113.

Figure 27B:
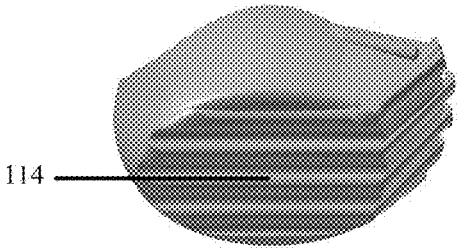
FIG. 27B is a view from the bottom and to one side of the object shown in FIG. 27A.
Figure 27C:
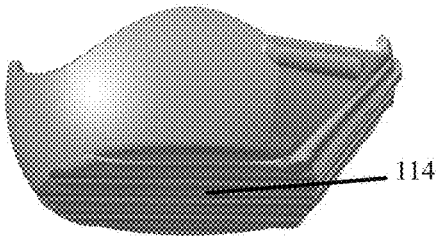
FIG. 27C is a view from the bottom and to one side of the object shown in FIG. 27A, but at more of an angle than that shown in FIG. 27B.
Figure 27D:
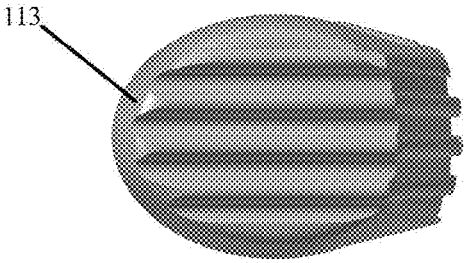
FIG. 27D is a view from the bottom of the object shown in in FIG. 27A.
Figure 27E:
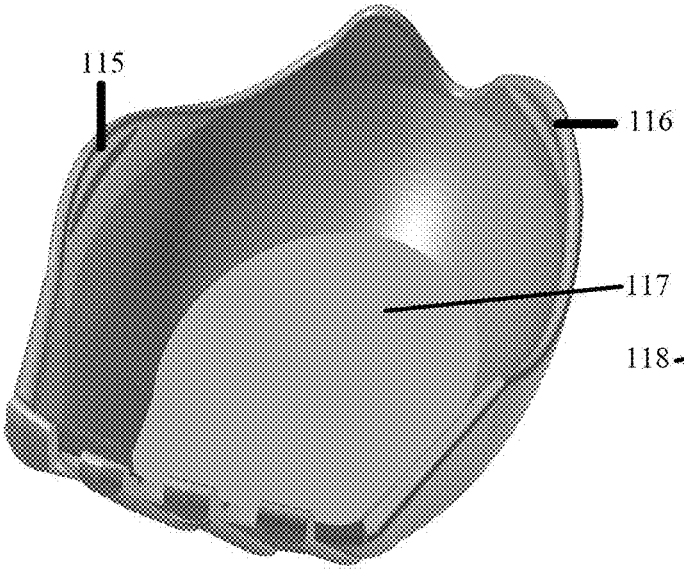
FIG. 27E depicts the inside of the object that is FIG. 27A.

FIG. 27A is also different from FIG. 25A in that FIG. 27A has ridges on its inside in the manner shown at FIG. 27E, elements 115 and 116. FIG. 27E depicts the inside of the object (117) that is FIG. 27A.

FIG. 27B is a view from the bottom (114) and to one side of the object shown in FIG. 27A.

FIG. 27C is a view from the bottom (114) and to one side of the object shown in FIG. 27A, but at more of an angle than that shown in FIG. 27B.

FIG. 27D is a view from the bottom of the object (113) shown in in FIG. 27A.

Figure 28A:
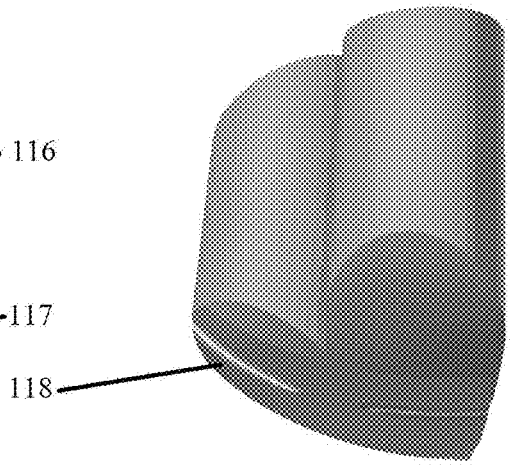
FIG. 28A shows where the protruding ridges of FIG. 27A hold onto an object placed in the center.
Figure 32A:
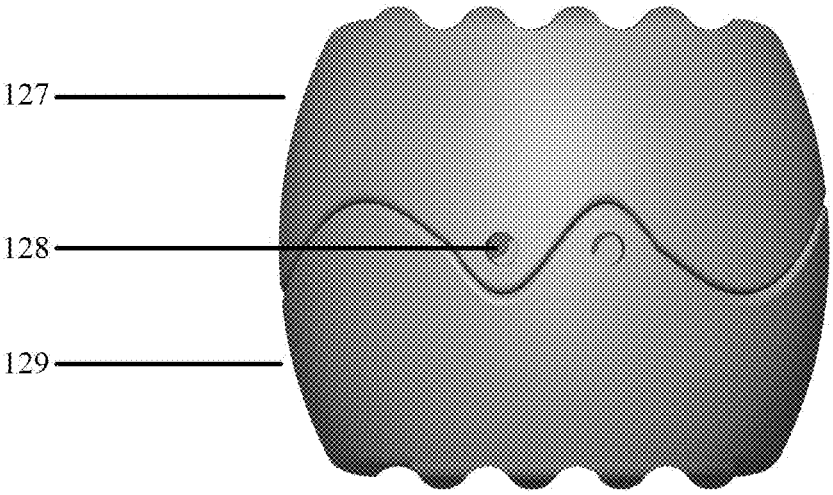
FIG. 32A is a profile view of two objects in the form of FIG. 30 snapped together with an object inside that is in the shape of the object depicted in FIG. 31A.

FIG. 28A shows where the protruding ridges of FIG. 27A hold onto an object placed in the center (118), like the heart object at FIG. 28A, to then snap the entire piece together as is shown in FIG. 32A.

Figure 28B:
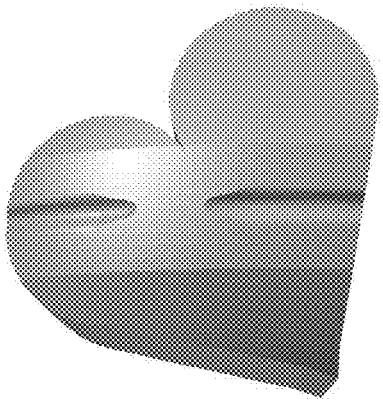
FIG. 28B is a view from the side of the object shown in FIG. 28A.

FIG. 28B is a view from the side of the object shown in FIG. 28A.

Figure 28C:
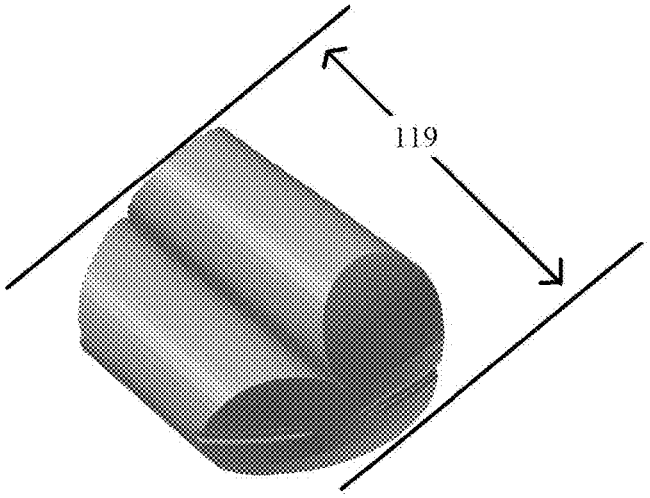
FIG. 28C is a view from the back side of the object in FIG. 28A that shows the symmetrical shape of the front side compared to the back side.

FIG. 28C is a view from the back side of the object in FIG. 28A that shows the symmetrical shape of the front side compared to the back side (119).

Figure 28D:
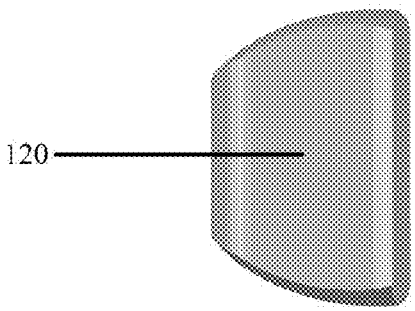
FIG. 28D is a view from the top of the object shown in FIG. 28A.

FIG. 28D is a view from the top (120) of the object shown in FIG. 28A.

Figure 29A:
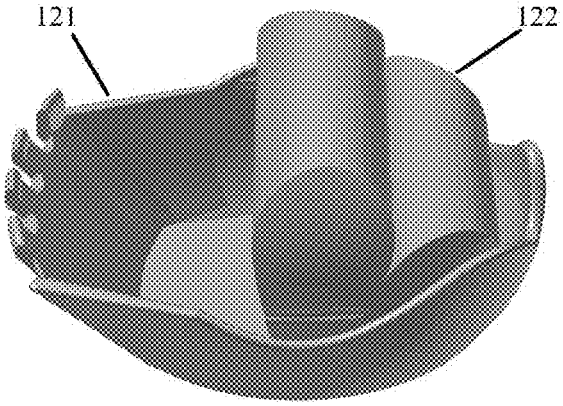
FIG. 29A shows how FIGS. 27A and 28A fit together.

FIG. 29A shows how FIGS. 27A (121) and 28A (122) fit together. When another object in the form of FIG. 27A snaps on top of FIG. 27A in FIG. 29A, that top object will be secured to the other objects by both the ring "s" snap described above and by the protruding (115, 116) and receding (118) pattern on FIGS. 27E and 28A.

Figure 29B:
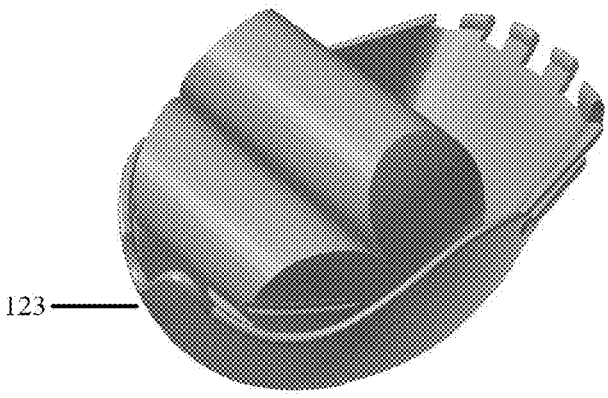
FIG. 29B is a view from the back and one side of the assembled pieces in FIG. 29A.

FIG. 29B is a view from the back (123) and one side of the assembled pieces in FIG. 29A.

Figure 30:
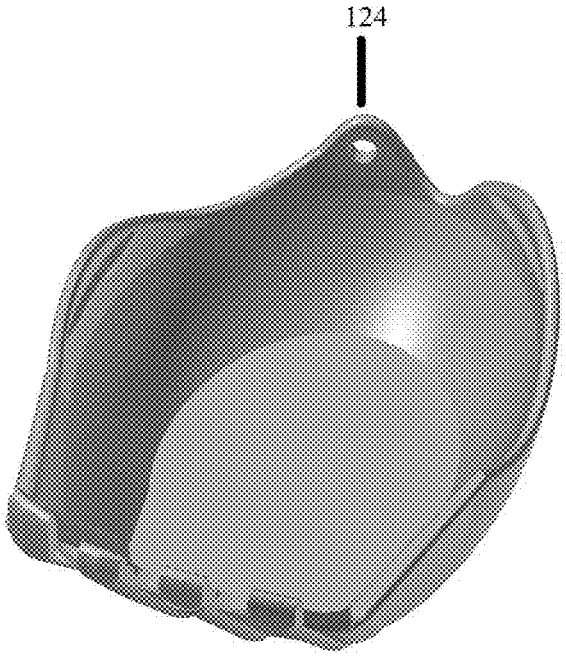
FIG. 30 is similar to FIG. 27A except it has a hole in the back of the hand denoted by element 5.

FIG. 30 is similar to FIG. 27A except it has a hole in the back of the hand denoted by element 124.

Figure 31A:
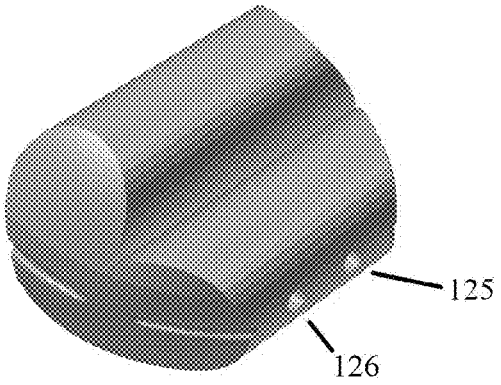
FIG. 31A is a heart with holes into which a string can be inserted and then be inserted through into the hole in FIG. 30.

FIG. 31A is a heart with holes into which a string can be inserted (125) and then be inserted through into the hole in FIG. 30 (124). When the other end of the string is also inserted through another FIG. 30 and the same FIG. 31A (126), all the pieces (127, 128, 129) can be snapped shut in the manner shown in FIG. 32A. In this way the string can be a necklace and the hand holding a heart can be how the necklace snaps together.

Figure 31B:
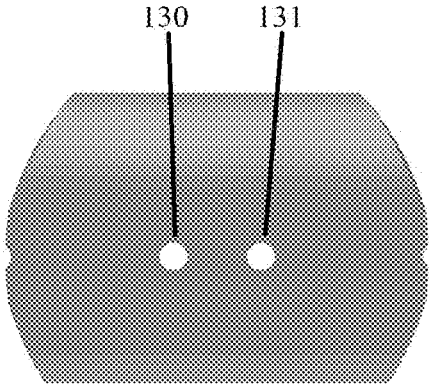
FIG. 31B is a profile view of the heart in FIG. 31A that shows how the string holes go through the object.

FIG. 31B is a profile view of the heart in FIG. 31A that shows how the string holes (130, 131) go through the object.

Figure 31C:
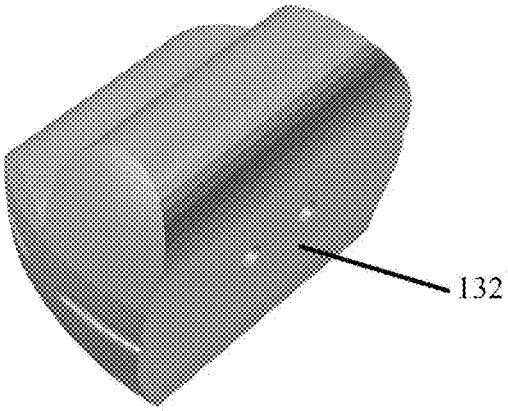
FIG. 31C is a view of the back side of the object shown in FIG. 31A.

FIG. 31C is a view of the back side of the object (132) shown in FIG. 31A.

FIG. 32A is a profile view of two objects in the form of FIG. 30 (127, 129) snapped together with an object inside (128) that is in the shape of the object depicted in FIG. 31A.

Figure 32B:
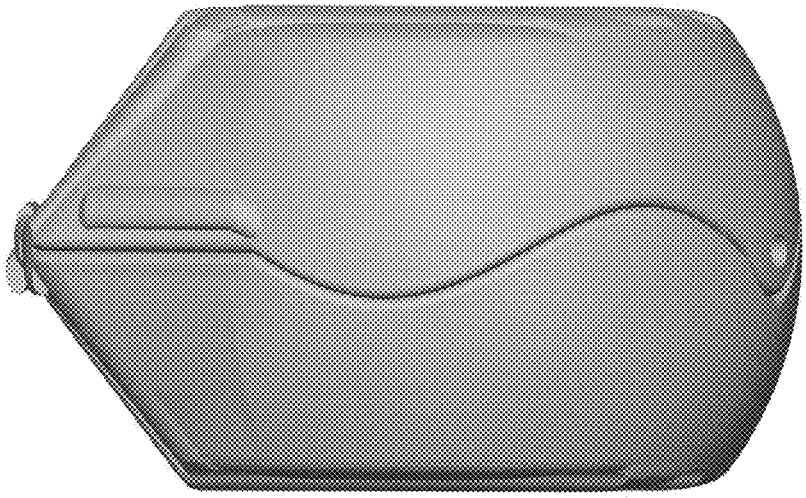
FIG. 32B is a profile view of the longest side of the assembled objects that are FIG. 32B.

FIG. 32B is a profile view of the longest side of the assembled objects that are FIG. 32B.

Figure 32C:
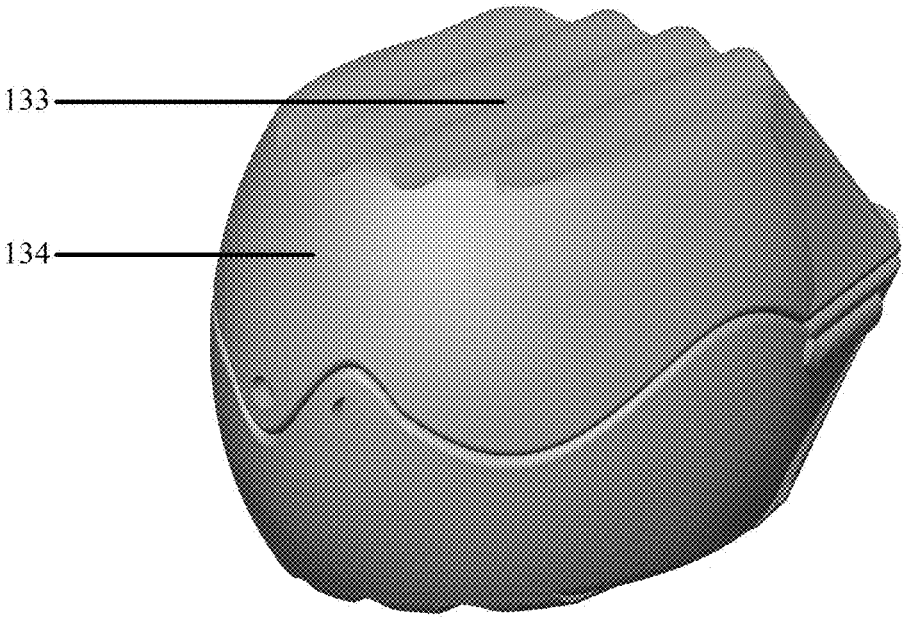
FIG. 32C is a view from the top and back of the assembled objects shown in FIG. 32A.

FIG. 32C is a view from the top (133) and back (134) of the assembled objects shown in FIG. 32A.

Figure 32D:
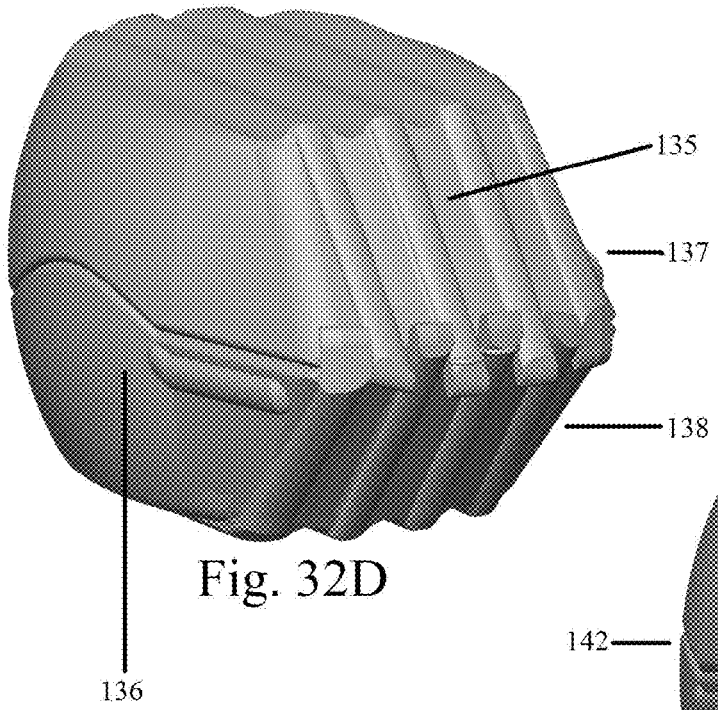
FIG. 32D is a view from the front and side of the assembled objects in FIG. 32A.

FIG. 32D is a view from the front (135) and side (136) of the assembled objects (137, 138) in FIG. 32A.

Figure 33:
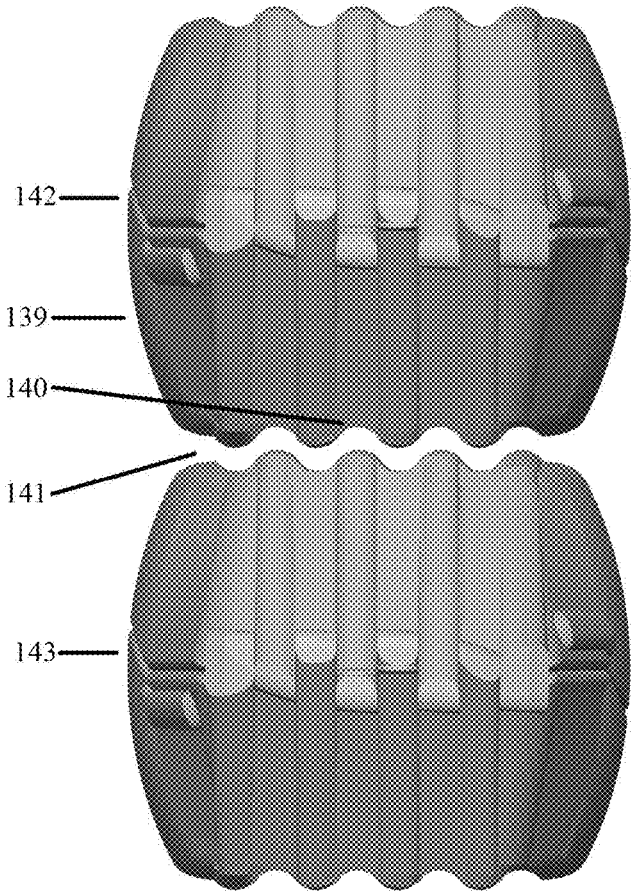
FIG. 33 is a demonstration of how FIG. 30 and other FIGs. with undulating patterns on their bottom side can be securely stacked to fit into themselves in a stable manner.

FIG. 33 is a demonstration of how FIG. 30 (139) and other FIGs. with undulating patterns on their bottom side (140) can be securely stacked to fit into themselves (141) in a stable manner.

The assembled hands (that appear in FIGS. 32 and 33 at 142 and 143, for example) are a symbol of how two people come together because the hand arrangement cannot be made by one person. The hands must both be of the same side (i.e., two right hands or two left hands, not one person's right and left hands being held together).

The simplicity of design and standard relationship of the features to each other give the pieces an elegance, and make it easier for others to design and use. Others can combine the bowls, combine features of the bowls, and those different combinations can be more easily manufactured with a wide range of objects because of the standard and simple relationship of the pieces to each other and of the features' relationship to each other.

The invention claimed is:

1. A building system comprising a plurality of objects;

wherein the objects are solid circular shaped strong and load-bearing capable of sustaining loads of 100 lbs. or more with standard sizes that enable them to assemble into objects that are hollow spheres, enclosed round trays, enclosed round platters, enclosed bowls or discs with bottoms that are flat or have smooth undulating surfaces that extend radially from the center;

wherein the objects have interfaces including snaps, smooth undulating surfaces or screws;

wherein a protruding part of the smooth undulating surfaces has a positive magnetic charge and a receding part of the smooth undulating surfaces has a negative magnetic charge so that when the pieces assemble the negative parts of the objects attract the positive parts of the objects;

wherein the objects include bowls assemble and disassemble into spherical or oval-shaped enclosed bowls that transport the objects to different locations in a building site by rolling around the building site with objects and building material inside to build pillars, walls, fences and decorative structures;

wherein the objects stack in a stable manner so the objects can be stored in a compact manner and have load-bearing strength to form pillars capable of sustaining loads of 100 lbs. or more;

wherein the bowls with undulating surfaces have simplified manufacturing, storage, transportation and assembly features because the bowls fit into themselves in a nested configuration, they are reversible, and they fit into other pieces of the same size and of different sizes in the building system;

wherein oval shaped bowls also communicate love with a separate heart-shaped object with indentations in the location of an arrow across the heart into which the lips on the top edges of the oval shaped bowls snap to form an enclosed bowl with the appearance of two hands holding a heart while the hands are clasped together.

2. A bowl set comprising a plurality of objects that are solid and load-bearing, capable of sustaining loads of 100 lbs. or more, wherein the objects include smooth bowls with smooth undulating edges on the top lips of the bowl edges and smooth undulations on the bottom that extend radially from the center in a manner that allows them to fit into themselves;

wherein protruding undulations on the smooth bowls with smooth undulating edges and smooth undulations on the bottom are positively charged magnetically and receding undulations on the smooth bowls are negatively charged so the bowls are also lids of other bowls because of their shapes and because they affix to each other magnetically;

wherein solid smooth load bearing oval-shaped smooth bowls have undulations on the top lips of the bowls that allow them to fit into other oval-shaped bowls in a reversible manner to form enclosed oval bowls with grooves on the bottom and top of the oval bowls so they reversibly fit into the bottom or top of other oval-shaped bowls to build strong compact constructions, larger constructions of pillars, rows of pillars that form stable load-bearing walls and staggered enclosed oval-shaped bowls that form strong walls;

wherein fingers extend from the top edge of a finger bowl to intersect in a reversible and stable manner with fingers from other finger bowls with the same shape, and one of the fingers has a ring on it that is a snap that snaps in a reversible manner with the ring on the finger of another finger bowl when they are affixed together in a reversible manner on account of both finger bowls having the same shaped finger with a ring that hooks into the other finger with a ring to form a snap;

wherein the insides of the smooth bowls have lips protruding inward that allows a separate object in the shape of a heart to be placed inside two bowls that are fitted together as a bowl and a lid such that the heart will snap the two bowls together;

wherein the smooth bowls are of a size that is appropriate for serving food without residual food getting stuck in crevasses or can be of other sizes to make smooth jewelry, stackable toys, and puzzles.

3. A building set comprising a plurality of solid load-bearing circular or spherical objects capable of sustaining loads of 100 lbs. or more with dimensions that make it easier to store the objects and control the objects to build constructions;

wherein the spherical objects assemble into hollow spheres that transport building materials through the constructions by rolling through the constructions while they are being built;

wherein the hollow spheres that transport building materials also build the constructions to economize on cost, space and resources for controlling, storing and transporting building materials;

wherein the objects include circular bowls with undulating lips on the top of the bowls and undulating surfaces on the bottom of the bowls with undulations that extend radially from the center wherein the circular bowls stack on top of each other in a stable manner with objects of the same size or of larger or smaller sizes to make walls that are also storage containers and that have insulation qualities because they have empty space inside solid sturdy stable constructions;

wherein the objects are in the shape of bowls, platters, discs, or plates that stack and assemble in secure ways with smooth undulating interfaces that interface with other smooth undulating surfaces extending radially from the center of the bottom of objects or from the edges of the tops of objects of the same size, or of different sizes and different undulating heights, magnet interfaces, or snap interfaces to form a wide range of useful human constructions that include walls, pillars, decorative sturdy durable landscape constructions that stand up to the elements that stack in a stable, smooth and secure way with objects of the same size or of larger or smaller sizes that also do not allow for dirt or debris to get stuck in crevasses.

* * * * *